US005735184A

United States Patent [19]

Miller et al.

[11] Patent Number: 5,735,184

[45] Date of Patent: Apr. 7, 1998

[54] POWERED TOOL POSITIONER SYSTEM

[75] Inventors: William R. Miller, Portland, Oreg.; Peter P. Ackerman, Vancouver; Robert F. Shinn, Camas, both of Wash.

[73] Assignee: Tidland Corporation, Camas, Wash.

[21] Appl. No.: 549,657

[22] Filed: Oct. 27, 1995

[51] Int. Cl.[6] ..... B26D 1/24; B26D 5/02

[52] U.S. Cl. ..... 83/504; 83/425.4; 83/499; 83/505; 83/508.5; 83/698.61

[58] Field of Search ..... 83/499, 508.2, 83/508.3, 504, 505, 677, 676, 698.61, 425.4

[56] References Cited

U.S. PATENT DOCUMENTS

| | | | |
|---|---|---|---|
| 523,298 | 7/1894 | Upton | 83/508.3 |
| 3,587,374 | 6/1971 | Stewart et al. . | |
| 3,646,418 | 2/1972 | Sterns et al. . | |
| 3,760,697 | 9/1973 | Besemann . | |
| 4,010,677 | 3/1977 | Hirakawa et al. | 83/499 |
| 4,033,217 | 7/1977 | Flaum et al. . | |
| 4,188,846 | 2/1980 | Jones et al. | 83/499 |
| 4,230,009 | 10/1980 | Coburn | 83/504 |
| 4,237,761 | 12/1980 | Coburn | 83/499 |
| 4,316,317 | 2/1982 | Ritzling | 83/504 |
| 4,843,933 | 7/1989 | Seki et al. | 83/499 |
| 4,926,730 | 5/1990 | Garrett | 83/499 |
| 5,072,641 | 12/1991 | Urban et al. . | |
| 5,083,489 | 1/1992 | Tidland et al. . | |
| 5,125,301 | 6/1992 | Miller et al. . | |
| 5,297,464 | 3/1994 | Mayer | 83/499 |
| 5,325,751 | 7/1994 | Green et al. | 83/504 X |
| 5,372,331 | 12/1994 | Miller et al. . | |
| 5,535,655 | 7/1996 | Kammann | 83/559 |

FOREIGN PATENT DOCUMENTS

| | | |
|---|---|---|
| 2062019 | 8/1992 | Canada . |
| 29509893 | 9/1995 | United Kingdom . |

*Primary Examiner*—Eugenia Jones
*Assistant Examiner*—Charles Goodman
*Attorney, Agent, or Firm*—Chernoff, Vilhauer, McClung & Stenzel

[57] ABSTRACT

A power operated tool positioner for moving a tool parallel to a tool-positioning axis has a first tool-contacting member movable parallel to the tool-positioning axis for exerting a first pushing force against the tool, and a second tool-contacting member movable transverse to the tool-positioning axis for simultaneously exerting a second pushing force against the tool perpendicular to the first pushing force to resist any tendency of the first pushing force to tilt the tool obliquely relative to the tool-positioning axis. A third tool-contacting member is preferably provided for exerting a third pushing force to push the tool in the opposite direction from the first tool-contacting member, likewise while the second tool-contacting member is simultaneously pushing against the tool. The second tool-contacting member preferably exerts its pushing force prior to the commencement of the first or third pushing force. The three tool-contacting members are preferably interconnected so as to move in unison, the second tool-contacting member being movable relative to the tool parallel to the tool-positioning axis while simultaneously exerting its second pushing force against the tool.

4 Claims, 4 Drawing Sheets

POWERED TOOL POSITIONER SYSTEM

BACKGROUND OF THE INVENTION

This invention relates to a powered tool positioner system for moving a tool substantially parallel to a tool-positioning axis by contacting the tool and pushing it along an elongate tool-supporting member.

It is conventional, as exemplified by U.S. Pat. No. 4,033,217, to employ one or more powered tool positioners to push tools, such as slitter knives, scoring heads, creaser heads, etc., slidably along an elongate tool-supporting member to position them precisely for the performance of their respective functions. A problem with such tool-positioning systems, however, is that they usually push against some portion of the tool which protrudes transversely from the tool-supporting member in an unbalanced manner tending to tilt the tool obliquely relative to the tool-supporting member. Such tilting not only adversely affects the accuracy of the tool positioning process but also can cause the tool to bind against the tool-supporting member and thereby resist the pushing force, causing excessive wear or other damage to the tool and/or tool-supporting member.

This problem can be alleviated to some extent by employing a tool positioner which contacts the tool in a more balanced fashion at multiple spaced locations on the tool, such as diametrically opposed locations on a circular cutting tool. However, such an arrangement requires a bulky tool-positioning mechanism which is not always possible within available space constraints. It also requires plural contact points between the positioner and the tool which are not conducive to positioning accuracy.

Moreover, if the tool has cutting edges formed on or adjacent to the surfaces against which the tool positioner must push, the pushing force of the tool positioner can dull or deform the cutting edges.

SUMMARY OF THE PRESENT INVENTION

The present invention overcomes the foregoing disadvantages by providing a tool positioner which moves a tool substantially parallel to a tool-positioning axis by exerting a first pushing force against the tool substantially parallel to the axis, while simultaneously exerting a second pushing force against the tool substantially transverse to the axis to thereby resist any tendency of the first pushing force to tilt the tool obliquely relative to the tool-positioning axis. The resistance to tilting of the tool minimizes the binding of the tool on the tool-supporting member and any positioning inaccuracies which might result from tilting of the tool.

According to another aspect of the invention, the second pushing force is exerted against the tool before the commencement of the first pushing force to ensure the effectiveness of the tilt-resisting function.

According to another aspect of the invention, the respective first and second tool-contacting members which exert the first and second pushing forces are interconnected so as to move in unison, and the second tool-contacting member is movable substantially parallel to the tool-positioning axis relative to the tool while simultaneously exerting its second pushing force against the tool.

According to another aspect of the invention, the first tool-contacting member has a substantially single-pointed tool-contacting surface for pushing against the tool, which promotes positioning accuracy and prevents the exertion of pushing forces against cutting edges which may be formed on or adjacent to the pushing surface of the tool, which forces might dull or otherwise damage such cutting edges.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
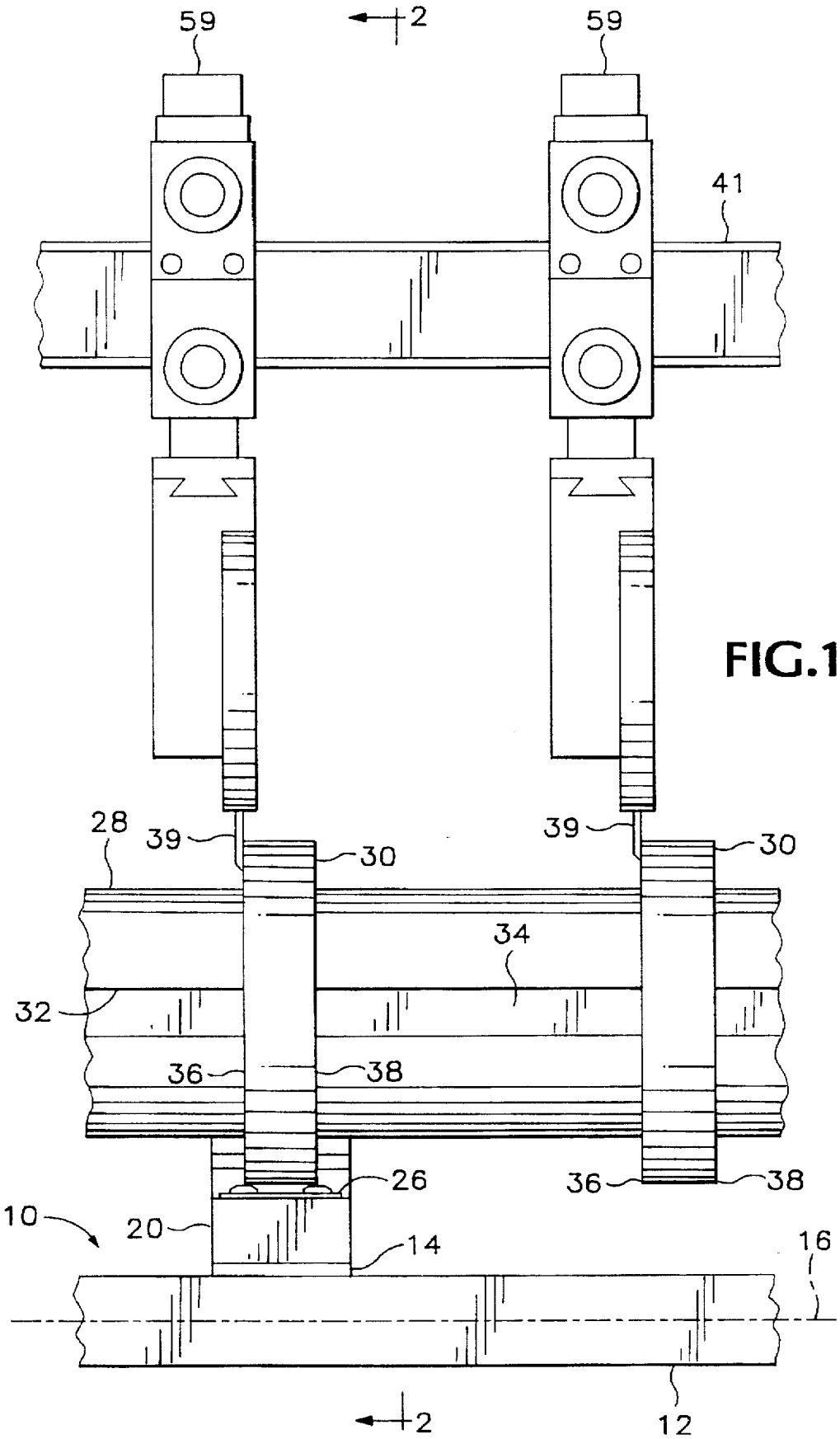
FIG. 1 is a front view of an exemplary embodiment of the tool positioner shown in relation to circular slitting knives to be positioned.

An exemplary embodiment of a tool positioner according to the present invention, indicated generally as 10 in the figures, includes a conventional linear actuator 12 having a carriage 14 movable along the actuator's tool-positioning axis 16 which is shown in phantom in FIG. 1. The linear actuator may include a motor-driven reversible continuous belt such as 18 to which the carriage 14 is connected or, alternatively, a motor-driven screw (not shown) for reversibly controlling the linear movement of the carriage 14 along the axis 16. Control of the motor-driven linear actuator 12 is accomplished by any suitable computer-operated control system enabling an operator to pre-set desired target positions parallel to the axis 16 and then move the carriage 14 to those positions. A conventional pulse-counting position sensor (not shown) determines when the linear actuator has moved the carriage 14 to the desired target position, at which time the actuator's motor drive is stopped. Control systems of this general type are exemplified by Miller et al. U.S. Pat. No. 5,125,301 which is incorporated herein by reference.

Mounted upon the carriage 14 of the linear actuator 12 is a tool-contacting assembly comprising a base 20 with a tool-contacting fixture 22 movably mounted thereon so as to be selectively extensible upwardly along a path generally transverse to the tool-positioning axis 16 by extension of a pneumatic piston 24 (FIG. 7) against the biasing force of a cantilevered leaf spring 26 which secures the tool-contacting fixture 22 to the base 20 by means of screws 27. In the exemplary embodiment shown in the figures, the path along which extension and retraction of the tool-contacting fixture 20 occurs is a curved path generally transverse to the axis 16, due to the cantilevered mounting of the spring 26. Alternatively, if other types of springs were used, the extension/ retraction path could be linear.

Figure 2:
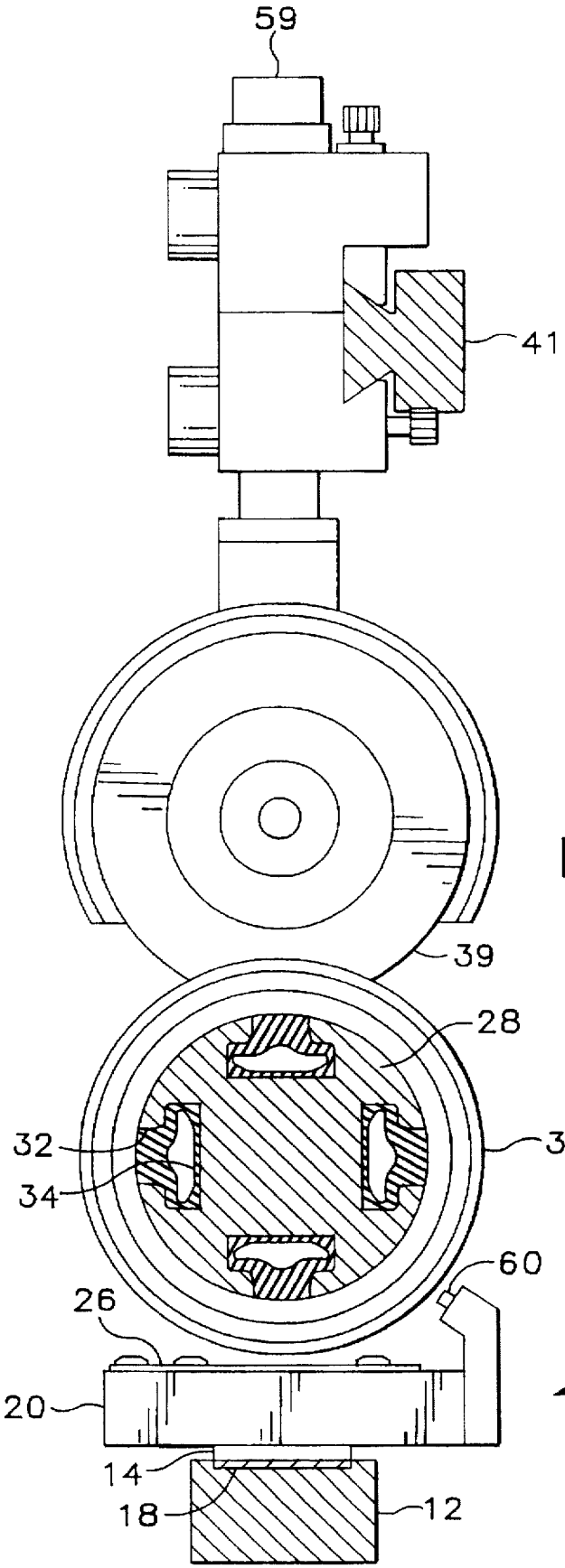
FIG. 2 is a cross-sectional view taken along line 2—2 of FIG. 1.
Figure 3:
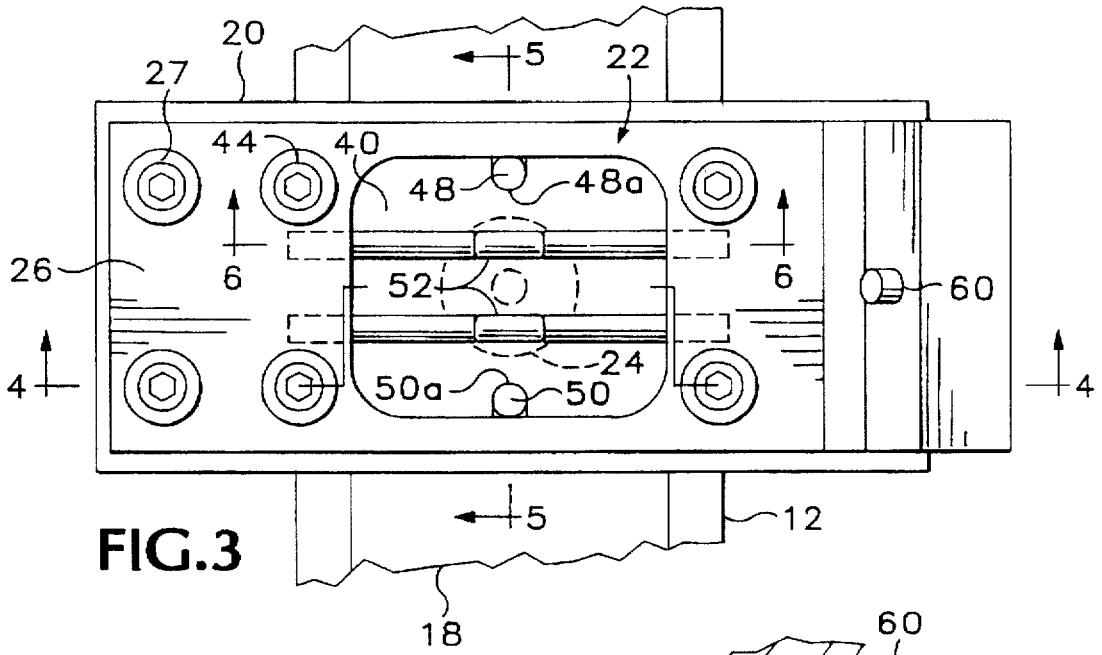
FIG. 3 is an enlarged top view of the tool positioner of FIG. 1.

The tool positioner 10 is located closely adjacent to an elongate tool-supporting member such as a shaft 28, extending parallel to the axis 16, upon which a plurality of tools 30 are mounted. The shaft 28 may be any of numerous different types of drive shafts capable of selectivity fixing the tools 30 to the shaft at different positions and selectively releasing them so that they can be repositioned. For example, a suitable pneumatically-expandable shaft would be one such as that shown in Miller et al. U.S. Pat. No. 5,372,331, modified to have straight longitudinal slots 32 and resilient pneumatically expandable bladders 34. With the bladders 34 in an unexpanded condition, the tools 30 are released from the shaft 28 and can slide along the shaft parallel to the axis 16. Conversely, with the bladders 34 expanded as shown in FIG. 2, the tools 30 are locked to the shaft in their respective positions. Alternatives to the shaft 28 could include rails or other elongate tool-supporting members along which tools can move in sliding or rolling engagement unless locked to the tool-supporting member by similar pneumatically or mechanically expandable devices on the supporting member, or by locking elements on the tools themselves.

The exemplary tools 30 are circular slitting knives having opposed peripheral cutting edges 36 and 38. Either of the edges 36, 38 can be used to cooperate with corresponding upper circular slitting knives 39 positionable along a rail 41 for cutting web materials into varying widths depending upon the positioning of the knives. A typical upper slitting knife structure is shown in greater detail in Tidland et al. U.S. Pat. No. 5,083,489, which is incorporated herein by reference. Virtually any other type of powered or non-powered tool for cutting, creasing, scoring, punching, drilling, etc., whether positionable along shafts, rails or other tool-supporting members, could be positioned in accordance with the present invention.

Figure 8:
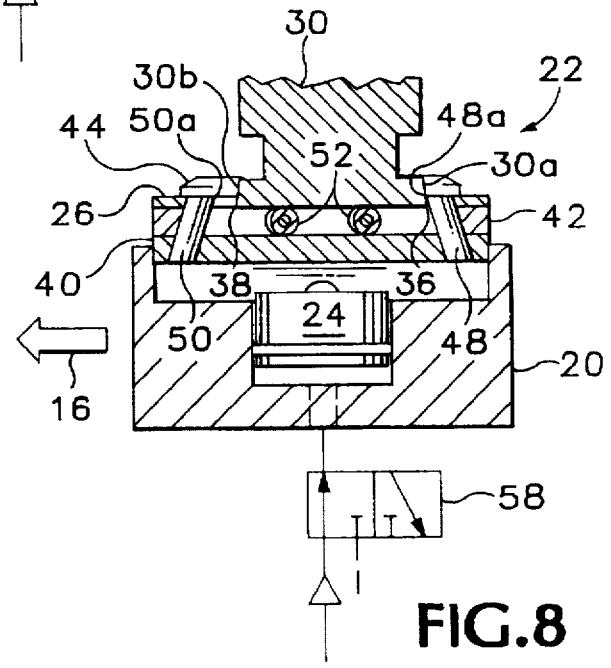
FIG. 8 is a cross-sectional view corresponding to FIG. 5 showing the tool positioner in a tool-contacting condition.

The tool-contacting fixture 22 of the tool positioner 10 comprises a bottom plate 40 atop which is mounted a rectangularly shaped peripheral frame 42 having a generally rectangular aperture in its center so as to form a depression surrounded by the frame 42. The leaf spring 26, frame 42, and bottom plate 40 are rigidly connected together by screws 44. An opposed pair of tool-contacting positioning members 48, 50, comprising upwardly converging cylindrical metal rods affixed to the inner surface of the frame 42, terminate at respective tool-contacting single points **48*a* and 50*a* so that they can push against a respective side 30*a* or 30*b* of a tool 30 at a single point, as shown in FIG. 8 with respect to side 30*a* and point 48*a*. Single point contact is enabled by the cylindrical shape of the member 48 or 50 and its angular relationship to the side surface 30*a* or 30*b* of the tool as shown in FIG. 8. Such single point contact enhances positioning accuracy and, in the case of a tool 30 such as that shown having cutting edges 36, 38**, enables contact with the tool at a point removed from the cutting edge so that dulling or other damage to the cutting edge is prevented.

Figure 6:
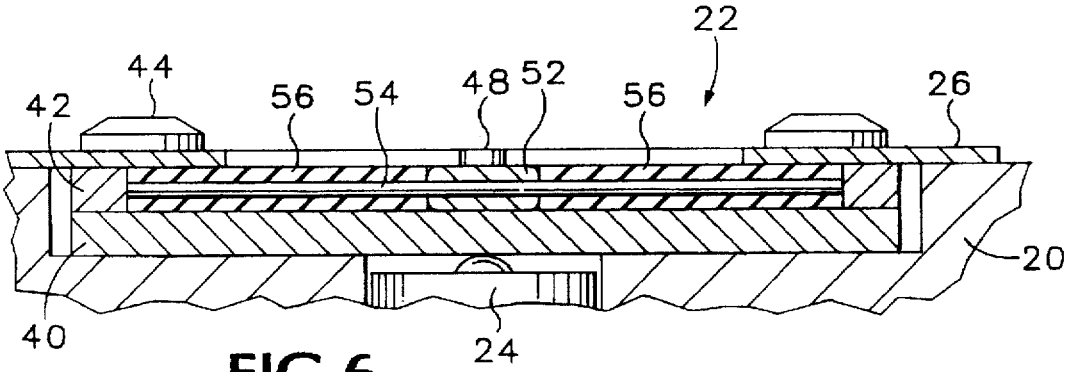
FIG. 6 is an enlarged cross-sectional view taken along line 6—6 of FIG. 3.

Resting on the bottom plate 40 of the tool-contacting fixture 22 are a pair of steel rollers 52 each journaled rotatably about a respective flexible wire axle 54, as shown in FIG. 6. Each axle 54 in turn is secured within a respective elastomer tube 56 clamped between the bottom plate 40 and the interior margin of the leaf spring 26 as shown in FIG. 6. The rollers 52 are spaced apart parallel to the tool-positioning axis 16 and can roll along the bottom plate 40 parallel to the axis 16 in either direction from their centered positions of FIG. 4. Such a displacement from their centered positions is shown, for example, in FIGS. 8 and 9. When so displaced, the rollers 52 are spring-biased toward their centered positions by the elastomer tubes 56. The rollers 52, their supporting bottom plate 40 and the piston 24 constitute a stabilizing tool-contacting assembly capable of exerting a pushing force against the tool 30 in a direction transverse to the axis 16 and toward the tool supporting member 28 in response to the extension of the piston 24 upon opening of its solenoid-operated air supply valve 58, as further explained below.

Figure 4:
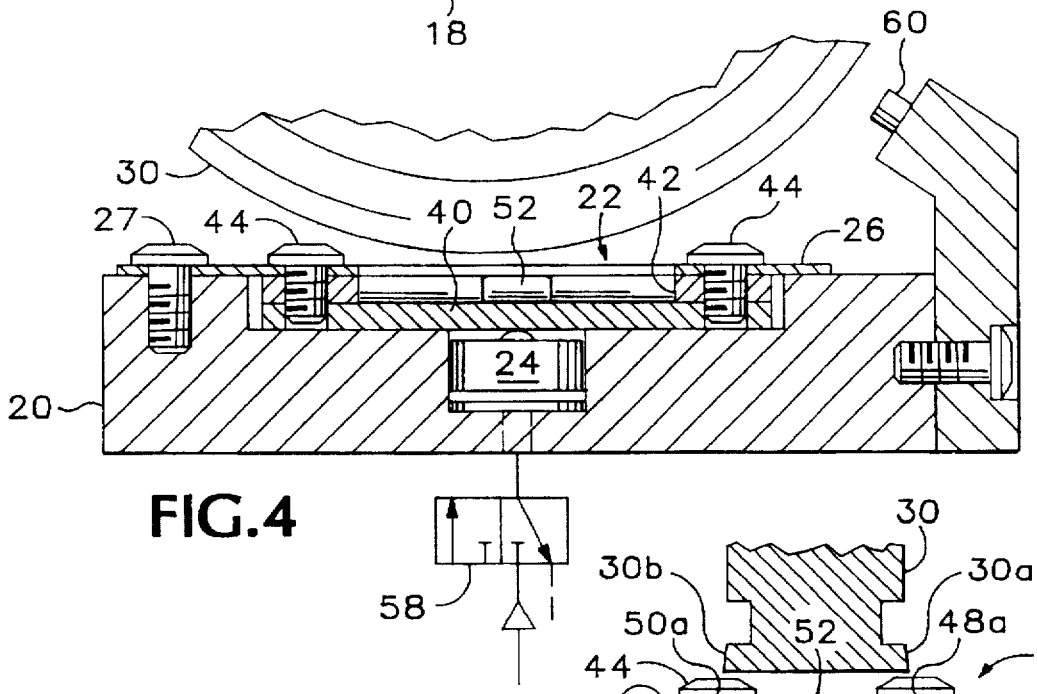
FIG. 4 is a cross-sectional view taken along line 4—4 of FIG. 3.
Figure 5:
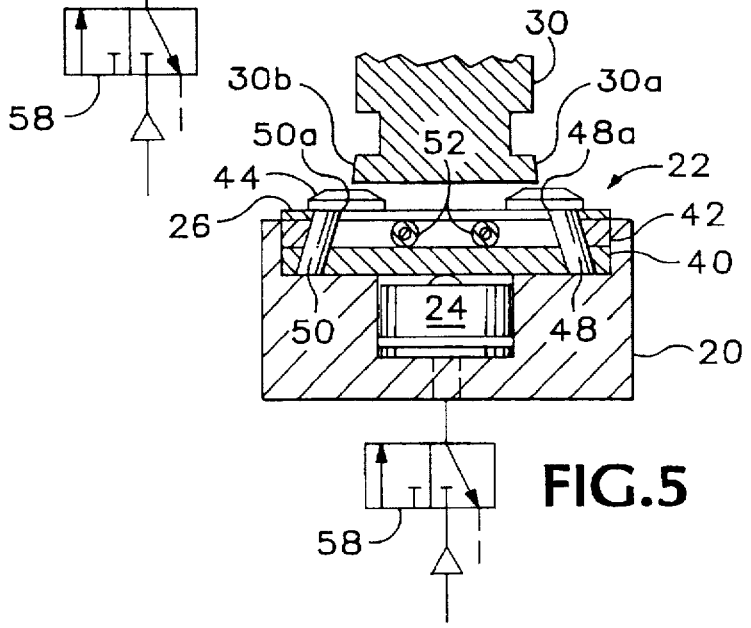
FIG. 5 is a cross-sectional view taken along line 5—5 of FIG. 3.

In operation, preparatory to repositioning the tools 30, the corresponding upper knives 39 are retracted upwardly by release of air pressure on their upwardly spring-biased pistons 59 in a conventional manner. The bladders 34 of the shaft 28 are relieved of their pneumatic pressure and retracted within the slots 32, thereby releasing the tools 30 so that they can slide freely along the shaft 28. The tool-contacting fixture 22 is in its retracted condition as shown in FIGS. 4 and 5 due to the closure of the air supply valve 58, which simultaneously exhausts the pressure on the piston 24 and enables the leaf spring 26 to retract the fixture 22.

Figure 7:
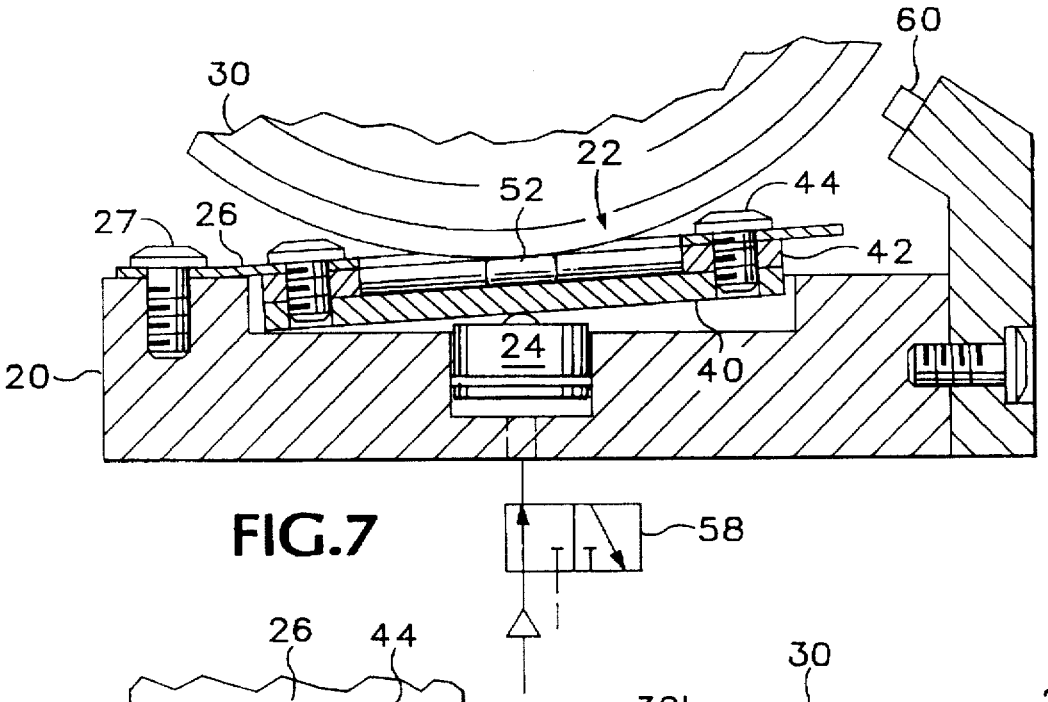
FIG. 7 s a cross-sectional view corresponding to FIG. 4 showing the tool positioner in a tool-contacting condition.

The linear actuator 12 first moves the retracted fixture 22 along the axis 16 to locate an edge 36 or 38 of each tool 30 by means of an inductive sensor 60 and store its location in computer memory. The memory also contains prestored information regarding the widths of the tools 30 so that their centers along the axis 16 are likewise known from their edge locations. Thereafter, the retracted fixture 22 is centered by the control system on the first tool 30 to be positioned along the axis 16 so that both of the tool-contacting positioning members 48, 50 are located outboard of the respective proximate sides **30*a*, 30*b* of the tool 30 as shown in FIG. 5. The solenoid valve 58 is opened by the control system and the piston 24 extends the tool-contacting fixture 22 upwardly toward the tool 30 as shown in FIG. 7 until the rollers 52 contact the periphery of the tool with a radially-inward pushing force toward the shaft 28. Such force is maintained by the piston 24 so long as the valve 58 remains open. Such extension of the fixture 22 also simultaneously moves the tool-contacting positioning members 48, 50 into radially-overlapping, but still noncontacting, relationship with the sides 30*a*, 30*b* of the tool 30**.

Figure 9:
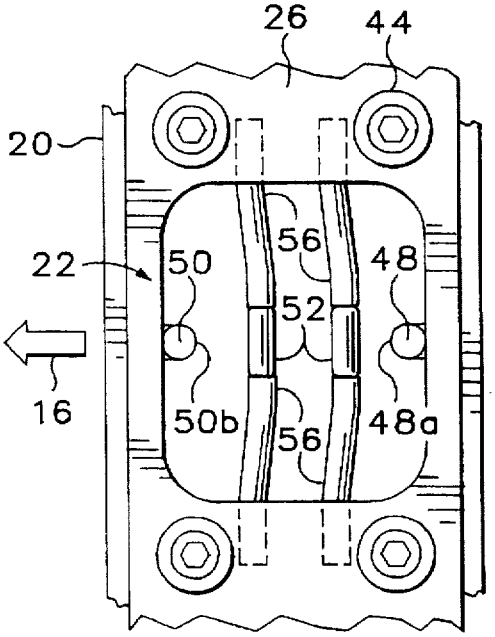
FIG. 9 is a top view of the tool positioner corresponding to FIG. 8.

Thereafter, depending upon which direction the tool 30 is to be moved along the shaft 28, the control system causes the linear actuator 12 to move the fixture 22 in the desired direction along the axis 16, causing the appropriate tool-contacting positioning member 48 or 50 to contact the side **30*a* or 30*b* of the tool 30 while simultaneously maintaining the radial pushing force against the tool through the rollers 52. Such movement to the left, for example, as shown in FIG. 8, causes the member 48 to contact the side 30*a* at the point 48*a*. As the member 48 is moved into contact with the side 30*a* of the tool 30 along the axis 16, the bottom plate 40 of the fixture 22 likewise moves along the axis 16 relative to the tool 30, causing the rollers 52 to roll sideways relative both to the tool 30 and to the bottom plate 40 into off-center positions as shown in FIGS. 8 and 9. The off-center displacement of the rollers 52 relative to the tool 30 is small, being only-half the translation of the tool-contacting member 48 relative to the tool 30. Thereafter, the linear actuator 12 continues to move the fixture 22 to the left along the axis 16 as shown in FIG. 8, causing the tool-contacting member 48 to push the tool 30 slidably along the shaft 28 toward its new position while the radial pushing force of the rollers 52 under the influence of the piston 24 is maintained. This radial pushing force resists any tendency of the pushing force exerted by the member 48 to tilt the tool 30 obliquely relative to the tool-positioning axis 16** during the repositioning movement.

During such repositioning movement, if any other tools 30 are obstructing the path of the particular tool being pushed, they will be pushed ahead of the particular tool.

When the tool has progressed slightly beyond its new desired position, the actuator 12 stops and reverses its direction thereby causing the opposite tool-contacting positioning member 50 to contact the opposite side 30*b* of the tool 30 and push it back toward its desired position in the manner previously described with respect to the member 48. Thus, any resistance of other tools 30, which may have previously been pushed ahead of the particular tool being positioned, is eliminated prior to final positioning to maximize accuracy. If the side 30*b* of the tool has the cutting edge intended to be used, the actuator 12 moves the fixture 22 exactly to the desired position and stops. On the other hand, if the side 30*a* of the tool has the cutting edge to be used, the actuator 12 once again moves the tool slightly beyond the desired position and again reverses direction so that final positioning of the tool will be performed by the member 48 pushing against the side 30*a* of the tool.

Once the desired position of the tool has been obtained, the actuator 12 halts the fixture 22 and reverses direction until the fixture 22 is once again stopped at a location centered on the tool along the axis 16, so that both members 48 and 50 no longer contact the tool 30. The valve 58 is then closed by the control system, exhausting the pressure on the piston 24 and enabling the leaf spring 26 to retract the fixture 22 away from the tool 30. Other tools 30 on the shaft 28 are thereafter repositioned, if necessary, in a similar manner in any convenient sequence until all tools 30 are in their proper positions, after which the bladders 34 on the shaft 28 are inflated to lock the tools to the shaft in their desired positions.

The upper tools 39 are similarly repositioned by their own tool-positioning apparatus before, after, or concurrently with the repositioning of the lower tools 30. In some applications, the upper tools may be repositioned by the tool positioner 10 concurrently with the lower tools by interconnecting corresponding upper and lower tools prior to repositioning.

The rollers 52 serve as friction-reducing means to enable the bottom plate 40 of the fixture 22 to move along the axis 16 relative to the tool 30 while simultaneously exerting a radial pushing force against the tool 30. Their purpose is to cause the frictional resistance between the plate 40 and the tool 30 along the axis 16 to be less than the sliding resistance between the tool 30 and the shaft 28. Without such a friction-reducing means of some type, such as rollers, ball bearings or the like, the frictional resistance between the plate 40 and the tool 30 would be as great as or greater than the frictional resistance between the tool 30 and the shaft 28. This would make it difficult or impossible to move the appropriate tool-contacting member 48 or 50 into contact with the side of the tool along the axis 16 because the friction between the plate 40 and the tool 30 would cause the tool to slide along the shaft ahead of the member 48 or 50. Such friction-reducing means enables the radial pushing force to be applied by the plate 40 prior to the commencement of the repositioning pushing force by the member 48 or 50, which is important in resisting any tendency of the tool to tilt. In other words, the radial pushing force stabilizes the tool against tilting much more reliably if it is applied prior to the commencement of the repositioning force than if it is applied afterwards.

As an alternative to such friction-reducing means the plate 40 could, within the scope of the invention, be separate from the tool-contacting members 48 and 50 so as not to be required to move in unison with them along the axis 16. However this would require separate actuation of the members 48 and 50 which would require a more complex structure.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A power-operated tool positioner for moving a tool substantially parallel to a tool-positioning axis, said tool positioner comprising at least a first tool-contacting positioning member having a first pushing surface facing toward, and movable by power selectively in, a first direction substantially parallel to said tool-positioning axis so as to exert a first pushing force against said tool in said first direction, and a tool-contacting stabilizing assembly having a second pushing surface facing toward, and movable by power selectively in, a second direction substantially transverse to said tool-positioning axis, so as to exert a second pushing force against said tool and wherein said tool-contacting positioning member and said tool-contacting stabilizing assembly are interconnected with each other so as to move in unison, said tool-contacting stabilizing assembly being movable in said first direction relative to said tool while exerting said second pushing force against said tool and said tool-contacting stabilizing assembly including friction-reducing means for contacting said tool to facilitate movement of said tool-contacting stabilizing assembly in said first direction relative to said tool while exerting said second pushing force against said tool.

2. The tool positioner of claim 1 wherein said friction-reducing means includes at least a pair of rotatable members for contacting said tool.

3. The tool positioner of claim 2 wherein said rotatable members are rollers having axes of rotation substantially transverse to said tool-positioning axis.

4. The tool positioner of claim 2 wherein said rotatable members are spaced apart in a direction substantially parallel to said tool-positioning axis.

* * * * *

UNITED STATES PATENT AND TRADEMARK OFFICE

CERTIFICATE OF CORRECTION

PATENT NO. : 5,735,184

DATED : April 7, 1998

INVENTOR(S) : Miller et al.

It is certified that error appears in the above-identified patent and that said Letters Patent is hereby corrected as shown below:

| | |
|---|---|
| Col. 2, Line 22 | Insert --i-- before the "s"<br>(Should read "is") |
| Col. 5, Line 12 | Delete [0n] (typed with a zero)<br>Insert --On-- |

Signed and Sealed this

Seventeenth Day of October, 2000

*Attest:*

Q. TODD DICKINSON

*Attesting Officer*

*Director of Patents and Trademarks*